US009692146B2

(12) United States Patent
Justi et al.

(10) Patent No.: US 9,692,146 B2
(45) Date of Patent: Jun. 27, 2017

(54) CONTACT ELEMENT

(71) Applicant: Kostal Kontact Systeme GmbH, Luedenscheid (DE)

(72) Inventors: Joern Justi, Luedenscheid (DE); Hans-Juergen Krach, Plettenberg (DE); Georg Schroeder, Drolshagen (DE); Uwe Pitzul, Hagen (DE); Wilfried Heringhaus, Herne (DE)

(73) Assignee: Kostal Kontakt Systeme GmbH, Luedenscheld (DE)

( * ) Notice: Subject to any disclaimer, the term of this patent is extended or adjusted under 35 U.S.C. 154(b) by 133 days.

(21) Appl. No.: 14/928,371

(22) Filed: Oct. 30, 2015

(65) Prior Publication Data

US 2016/0056550 A1 Feb. 25, 2016

Related U.S. Application Data

(63) Continuation of application No. PCT/EP2014/060993, filed on May 27, 2014.

(51) Int. Cl.
*H01R 4/48* (2006.01)
*H01R 13/6583* (2011.01)
(Continued)

(52) U.S. Cl.
CPC ..... *H01R 4/48* (2013.01); *H01R 4/20* (2013.01); *H01R 13/6583* (2013.01); *H01R 13/6592* (2013.01)

(58) Field of Classification Search
CPC ... H01R 9/0518; H01R 9/032; H01R 13/6592
(Continued)

(56) References Cited

U.S. PATENT DOCUMENTS 4,070,751 A * 1/1978 Hogendobler ..... H01R 9/0518 29/418
4,131,332 A * 12/1978 Hogendobler ..... H01R 9/0518 439/585
(Continued)

FOREIGN PATENT DOCUMENTS

DE 1515371 B2 5/1971
DE 19944167 A1 3/2001
(Continued)

OTHER PUBLICATIONS

The International Bureau of WIPO, International Preliminary Report on Patentability for International Application No. PCT/EP2014/060993 issued Dec. 1, 2015.
(Continued)

*Primary Examiner* — Ross Gushi
(74) *Attorney, Agent, or Firm* — Brooks Kushman P.C.

(57) ABSTRACT

A contact element for connecting to a cable having a braided shield includes a spring contact sleeve and a crimp sleeve. The spring contact sleeve has an annular ring and spring contacts arranged circumferentially on one end of the annular ring. The spring contact sleeve and the crimp sleeve form an enclosed hollow cavity between one another when the crimp sleeve is joined to the annular ring. The hollow cavity is configured to fully receive therein an exposed portion of the braided shield provided for connection of the contact element to the cable.

20 Claims, 5 Drawing Sheets

(51) Int. Cl.
*H01R 4/20* (2006.01)
*H01R 13/6592* (2011.01)

(58) Field of Classification Search
USPC ..... 439/98, 99, 607.41–607.52, 583–585
See application file for complete search history.

(56) References Cited

U.S. PATENT DOCUMENTS 4,243,290 A * 1/1981 Williams ..... H01R 13/65802 439/607.52
4,355,854 A * 10/1982 Williams ..... H01R 13/622 285/305
4,377,320 A * 3/1983 Lathrop ..... H01R 24/40 439/585
4,412,717 A * 11/1983 Monroe ..... H01R 9/0518 439/581
4,808,128 A * 2/1989 Werth ..... H01R 13/65802 29/857
4,854,891 A * 8/1989 Kamei ..... H01R 13/6592 439/462
4,929,189 A * 5/1990 Sekiguchi ..... H01R 13/627 439/352
4,990,104 A * 2/1991 Schieferly ..... H01R 13/432 439/578
4,990,105 A * 2/1991 Karlovich ..... H01R 9/0518 439/578
5,102,351 A * 4/1992 Meshel ..... H01R 9/032 439/585
5,183,417 A * 2/1993 Bools ..... H01R 9/032 439/583
5,267,878 A * 12/1993 Shinji ..... H01R 9/032 439/607.5
5,616,887 A 4/1997 Kirma
5,691,506 A * 11/1997 Miyazaki ..... H01R 4/646 174/652
5,707,253 A * 1/1998 Matsumoto ..... H01R 9/0524 439/607.5
5,746,625 A * 5/1998 Aparicio ..... H01R 13/6593 439/607.41
5,942,730 A 8/1999 Schwarz et al.
5,965,847 A * 10/1999 Tanaka ..... H01R 9/0527 174/84 R
6,048,227 A * 4/2000 Rupp ..... H01R 9/0521 439/607.41
6,116,955 A * 9/2000 Lazaro, Jr. ..... H01R 9/032 439/607.45
6,152,746 A * 11/2000 Brown ..... H01R 9/0518 439/99
6,280,208 B1 * 8/2001 Masuda ..... H01R 4/64 174/359
6,648,690 B2 * 11/2003 Saito ..... H01R 9/0524 439/607.44
6,672,894 B2 * 1/2004 Sprunger ..... H01R 9/032 439/449
6,688,896 B2 * 2/2004 Matsumoto ..... H02G 3/0666 439/98
6,692,299 B1 * 2/2004 Stockmaster ..... H01R 9/0518 439/578
6,764,350 B2 * 7/2004 Kosmala ..... H01R 9/032 439/598
6,781,059 B2 * 8/2004 Mizutani ..... H01R 13/6592 174/75 C
6,793,532 B2 * 9/2004 Saito ..... H01R 9/0518 174/360
6,805,588 B2 * 10/2004 Yamamoto ..... H01R 9/035 439/607.41
6,864,426 B2 * 3/2005 Miyazaki ..... H01R 13/655 174/75 C
6,922,893 B2 * 8/2005 Ingram ..... F16L 25/0036 285/222.5
7,044,756 B1 * 5/2006 Asakura ..... H01R 9/032 439/607.41
7,268,298 B2 * 9/2007 Asakura ..... H01R 9/0512 174/78
7,368,664 B2 * 5/2008 Asakura ..... H01R 9/0512 174/78
7,491,071 B2 * 2/2009 Hamai ..... H01R 9/0527 439/882
7,534,138 B1 * 5/2009 Gump ..... H01R 9/032 439/564
7,543,368 B2 * 6/2009 Ingram ..... F16L 33/2071 29/447
7,598,455 B2 * 10/2009 Gump ..... H01R 9/0518 174/75 C
7,666,032 B2 * 2/2010 Aoki ..... H01R 9/032 29/844
7,674,972 B2 * 3/2010 Gladd ..... H01R 13/658 174/34
7,726,985 B2 * 6/2010 Gladd ..... H01R 9/0518 439/585
7,749,025 B2 * 7/2010 Aoki ..... H01R 9/032 439/607.41
7,811,133 B2 * 10/2010 Gray ..... H01R 9/0527 439/584
7,819,694 B2 * 10/2010 Miyashita ..... H01R 4/18 439/578
8,157,594 B2 * 4/2012 Gilliam ..... H01R 9/0521 439/578
8,191,250 B2 * 6/2012 Kawase ..... H01R 9/0509 174/75 C
8,323,055 B2 * 12/2012 Plate ..... H01R 9/0518 439/578
8,425,240 B2 * 4/2013 Lee ..... H01R 13/6593 439/607.41
8,425,251 B1 * 4/2013 Pedruzzi ..... H01R 13/5812 439/470
8,460,015 B2 * 6/2013 Deno ..... H01R 9/0518 174/78
8,602,797 B2 * 12/2013 Omae ..... H01R 9/0518 439/99
8,637,770 B2 * 1/2014 Adachi ..... B60R 16/0222 174/74 R
8,808,012 B2 * 8/2014 Omae ..... H01R 4/646 439/98
8,827,744 B2 * 9/2014 Poma ..... H01R 4/20 439/585
8,946,553 B2 * 2/2015 Kawase ..... H01R 9/0509 174/74 R
8,956,189 B2 * 2/2015 Imahori ..... H01R 4/10 439/587
9,017,110 B2 * 4/2015 Guillanton ..... H01R 9/0503 174/34
9,022,794 B2 * 5/2015 Wang ..... H01R 13/5202 439/271
9,039,450 B2 * 5/2015 Germ ..... H01R 9/032 439/607.41
9,093,782 B2 * 7/2015 Wang ..... H01R 13/641
9,153,878 B2 * 10/2015 Poma ..... H01R 4/184
9,306,355 B2 * 4/2016 Hanazaki ..... H01R 4/20
9,318,849 B2 * 4/2016 Kobayashi ..... H01R 13/5205
9,346,420 B2 * 5/2016 Adachi ..... B60R 16/0207
2001/0027040 A1 * 10/2001 Yoshioka ..... H01R 4/646 439/98
2002/0106918 A1 * 8/2002 Saito ..... H01R 9/0524 439/98
2003/0003805 A1 * 1/2003 Yamamoto ..... H01R 9/035 439/607.41
2003/0221850 A1 * 12/2003 Mizutani ..... H01R 13/6592 174/36
2004/0099428 A1 * 5/2004 Miyazaki ..... H01R 13/655 174/366
2005/0215122 A1 * 9/2005 Nishida ..... H01R 9/032 439/607.41
2006/0049628 A1 * 3/2006 Ingram ..... F16L 25/0036 285/256
2006/0121758 A1 * 6/2006 Asakura ..... H01R 9/032 439/98

(56) References Cited

U.S. PATENT DOCUMENTS

2006/0223374 A1* 10/2006 Ingram ..... F16L 25/0036 439/607.41
2007/0079495 A1* 4/2007 Ingram ..... F16L 25/0036 29/508
2008/0119088 A1* 5/2008 Noh ..... H01R 9/0518 439/607.41
2010/0000788 A1* 1/2010 Kawase ..... H01R 9/0509 174/74 R
2010/0216323 A1* 8/2010 Kawamura ..... H01R 13/6593 439/95
2012/0028500 A1* 2/2012 Lee ..... H01R 13/6593 439/607.01
2012/0190238 A1* 7/2012 Omae ..... H01R 13/6592 439/620.01
2013/0084728 A1* 4/2013 Omae ..... H01R 4/646 439/271
2014/0179161 A1* 6/2014 Imahori ..... H01R 13/6592 439/607.45
2014/0209377 A1* 7/2014 Wang ..... H02G 15/013 174/658
2014/0235104 A1* 8/2014 Wang ..... H01R 13/648 439/607.41
2015/0099397 A1* 4/2015 Listing ..... H01R 9/0527 439/607.41
2015/0140851 A1* 5/2015 Wang ..... H01R 13/5221 439/275
2016/0056550 A1* 2/2016 Justi ..... H01R 13/6583 439/607.01

FOREIGN PATENT DOCUMENTS

DE 20200921 U1 5/2003
DE 102011102566 A1 9/2012
DE 102012105258 A1 12/2013

OTHER PUBLICATIONS

European Patent Office, International Search Report for corresponding International Application No. PCT/EP2014/060993 mailed Sep. 22, 2014.

* cited by examiner a)

b)

a)

b)

a)

b)

a)

b)

CONTACT ELEMENT

CROSS-REFERENCE TO RELATED APPLICATIONS

This application is a continuation of International Application No. PCT/EP2014/060993, published in German, with an International filing date of May 27, 2014, which claims priority to DE 10 2013 009 184.5, filed May 31, 2013; the disclosures of which are hereby incorporated in their entirety by reference herein.

TECHNICAL FIELD

The present invention relates to a contact element for making a shield connection to a cable provided with a braided shield, the contact element including (i) a spring contact sleeve having an annular ring and spring contacts connected circumferentially to the annular ring and (ii) a crimp sleeve that can be connected to the annular ring.

BACKGROUND

DE 10 2011 102 566 A1 describes a contact element having a spring contact sleeve and a crimp sleeve. The spring contact sleeve has an annular ring and spring contacts arranged circumferentially on the annular ring. Each spring contact is respectively formed of a substantially linear supporting arm. The supporting arm of each spring contact is connected to a respective spring arm through a U-shaped curved section.

The connection of the contact element to a braided cable is accomplished by pushing the spring contact sleeve onto the cable sheath of the cable whereby the supporting arms rest against the cable sheath. Since a fixed connection has not yet been achieved, the spring contact sleeve can be rotated and moved into a desired position on the cable sheath. The braided shield of the cable is folded back in such a manner that the braided shield contacts the supporting arms to complete the connection to the braided shield. In a subsequent assembly step the crimp sleeve is pushed over the supporting arms so that the crimp sleeve surrounds the braided shield from the outside. The crimp sleeve is then pressed together with the supporting arms and the braided shield located between them.

A disadvantage of this contact element is the relatively elaborate design that is required to bend the supporting arms and the spring arms. A particular drawback is that the crimp sleeve, which is cylindrical shaped, cannot completely enclose the braided shield from all sides. This is disadvantageous for high voltage contacts since individual loose braided shield strands, which can result from stripping the cable, and exposure of the braided shield can cause dangerous short circuits.

SUMMARY

An object is a contact element that is characterized by a relatively simple and cost-effective design and is relatively simple to assemble to a cable having cable shielding and can produce a safe electrically shielded connection.

In carrying out at least one of the above and/or other objects, a contact element for connecting to a cable having a braided shield is provided. The contact element includes a spring contact sleeve and a crimp sleeve. The spring contact sleeve has an annular ring and spring contacts arranged circumferentially on one end of the annular ring. The spring contact sleeve and the crimp sleeve form an enclosed hollow cavity between one another when the crimp sleeve is joined to the annular ring. The hollow cavity is configured to fully receive therein an exposed portion of the braided shield provided for connection of the contact element to the cable.

Further, in carrying out at least one of the above and/or other objects, a cable assembly is provided. The cable assembly includes a cable and a contact element. The cable has a braided shield. The contact element has a spring contact sleeve and a crimp sleeve. The spring contact sleeve has an annular ring and spring contacts arranged circumferentially on one end of the annular ring. The spring contact sleeve and the crimp sleeve form an enclosed hollow cavity between one another when the crimp sleeve is joined to the annular ring. The spring contact sleeve and the crimp sleeve are placed on the cable with the cable extending through aperture passages of the spring contact sleeve and the crimp sleeve and the crimp sleeve is joined to the annular ring to thereby form the enclosed hollow cavity between the spring contact sleeve and the crimp sleeve. The hollow cavity fully receives therein in a physical contact manner an exposed portion of the braided shield to thereby electrically connect the contact element to the cable.

An embodiment provides a contact element for contacting the cable shielding (e.g., braided shield) of a cable in a shielded manner. The contact element includes a spring contact sleeve and a crimp sleeve. The spring contact sleeve has an annular ring and spring contacts. The spring contacts are circumferentially arranged on one end of the annular ring. The spring contact sleeve and the crimp sleeve are placed on the cable with the cable extending through aperture passages of the spring contact sleeve and the crimp sleeve. The spring contact sleeve and the crimp sleeve form a hollow cavity (i.e., receptacle chamber) between one another when the crimp sleeve is joined to the spring contact sleeve. The hollow cavity is enclosed by the spring contact sleeve and the crimp sleeve. The hollow cavity can completely accommodate therein an exposed portion of the braided shield. The exposed portion of the braided shielded accommodated within the cavity is in physical contact with the spring contact sleeve and the crimp sleeve thereby contacting the contact element and the cable together in a shielded manner.

In embodiments, the spring contact sleeve and the crimp sleeve form a hollow cavity when joined together. The hollow cavity is formed between the spring contact sleeve and the crimp sleeve. An exposed section of the braided shield of the cable, which is provided for the connection of the cable to the contact element, is accommodated within the hollow cavity. That is, the hollow cavity completely encloses in a physical contacting manner the exposed section of the braided shield thereby connecting the contact element and the braided shield of the cable together.

In embodiments, the crimp sleeve is in the shape of a cap. The cap includes a base plate having a circularly shaped aperture passage extending therethrough. The crimp sleeve is pushed onto the cable with the cable extending through the aperture passage of the crimp sleeve. The diameter of the aperture passage of the crimp sleeve corresponds closely to the outer dimension of the inner insulation of the cable. Thus, the crimp sleeve tightly seals to the portion of the cable extending through the aperture passage of the crimp sleeve. That is, the crimp sleeve tightly seals to the inner insulation of this portion of the cable.

Because of the complete enclosure of the stripped braided shield of the cable within a receptacle chamber formed by the hollow cavity and a part of the crimp sleeve that surrounds it and the spring contact sleeve, no loose sections of the braided shield can move around and give rise to short circuits. This is advantageous when the conductor contact is made to a high voltage cable carrying high currents and voltages, as for example in an electric vehicle.

In embodiments, the crimp sleeve has an integrally molded structured (i.e., gripping) inner contour on its inner surfaces. The inner contour can be designed, for example, as a spiral, helix, diamond shaped, or corrugated pattern. The gripping inner contour enables the braided shield of the cable to be pulled completely under the crimp sleeve with rotational movements while the crimp sleeve is being attached to the spring contact sleeve. The stripped sections of the braided shield are thereby completely enclosed in the hollow cavity formed by the spring contact sleeve and the crimp sleeve.

In embodiments, the spring contact sleeve assumes a relatively simple shape that does not require U-shaped bending of the spring contacts of the spring contact sleeve. The spring contact sleeve can thus be manufactured in a relatively simple and cost-effective manner as a single molded part, in particular through a thermoforming process.

In embodiments, the spring contacts of the spring contact sleeve are a cover surface whose free end sections extend away from the annular ring of the spring contact sleeve. The spring contacts can form an ascending section with respect to the axis of symmetry of the spring contact sleeve and an adjoining section that is parallel to the axis of symmetry or at least ascends noticeably less steeply. The ascending sections deflect when a cylindrically shaped section of a metal housing is pushed over the spring contact sleeve. The parallel or slightly ascending sections, possibly using integrally molded contact points, lie against the inner surface of the metal housing and thereby produce well-defined contact junctions making a good electrical connection.

In embodiments, the annular ring of the spring contact sleeve has an uninterrupted annular surface. As a result of this an increase in stability is achieved as compared to an interrupted lamellar structure, especially for the attachment of the crimp sleeve.

In embodiments, the annular ring of the spring contact sleeve has a collar on its end section. (The spring contacts are arranged on the other end section of the annular ring.) The diameter of the collar is smaller than the inner diameter of the spring contact sleeve. The inner diameter of the spring contact sleeve is determined so that the spring contact sleeve rests snugly on the exterior cable sheath when the spring contact sleeve is pushed over the cable. The collar of the annular ring thereby strikes the front edge of the cable sheath, which is formed as a result of a portion of the cable sheath being stripped off the cable. The collar thus determines the position of the spring contact sleeve on the cable.

In embodiments, the contact element can be used on a high voltage coaxial cable, for example in electrically powered motor vehicles or in energy supply systems that use regenerative energy sources.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
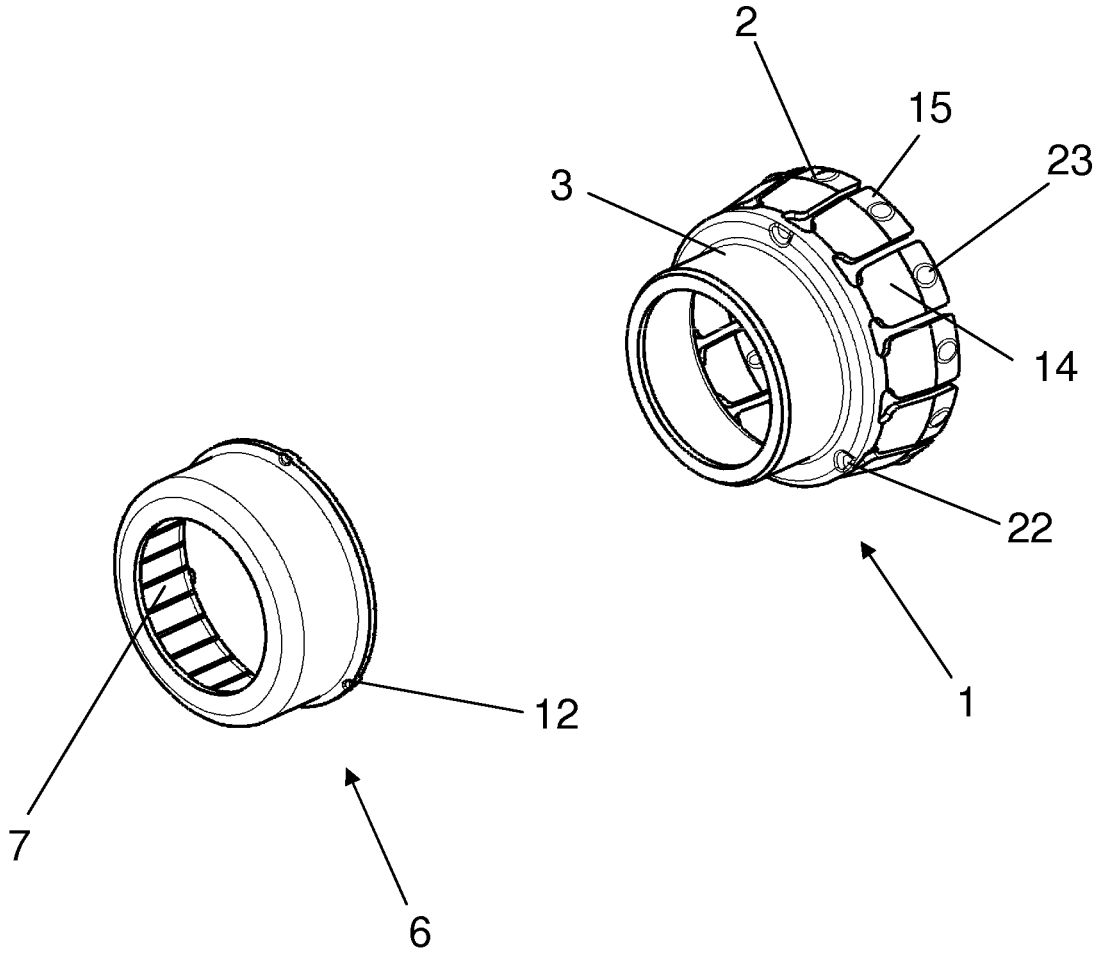
FIG. 1 illustrates a contact element having a spring contact sleeve and a crimp sleeve, the contact element being in a disassembled state in which the spring contact sleeve and the crimp sleeve are not joined together.

Referring now to FIG. 1, a contact element for contacting braided shield 4 of a cable 5 (not shown in FIG. 1) in a shielded manner is shown. The contact element includes a spring contact sleeve 1 and a crimp sleeve 6. Spring contact sleeve 1 and crimp sleeve 6 can be joined together to form the assembled contact element. As shown in FIG. 1, the contact element is in a disassembled state in which spring contact sleeve 1 and crimp sleeve 6 are not joined together.

Spring contact sleeve 1 is a unitary molded component. Spring contact sleeve 1 includes an annular ring 3 and a plurality of flat surface spring contacts 2. Spring contacts 2 are integrally molded circumferentially on an end section of annular ring. Spring contacts 2 form a lamellar crown that opens in a direction extending away from the end section of annular ring 3.

Each spring contact 2 has a first spring contact portion 14, a second spring contact portion 15, and a contact point 23. First spring contact portion 14 steeply ascends relative to the axis of symmetry of spring contact sleeve 1. Second spring contact portion 15 is parallel to or ascends at a noticeably flatter rate to the axis of symmetry of spring contact sleeve 1. The more steeply ascending first spring contact portions 14 deflect while being pushed radially inward by a cylindrically shaped socket section 18 of a metal housing 21 pushed over the assembled contact element (shown in FIG. 9). The flatter second spring contact portions 15 lie against the inner surface of socket section 18 of metal housing 21 pushed over the assembled contact element (shown in FIG. 9). Contact points 23 of spring contacts 2 are respectively integrally molded on second spring contact portions 15. Contact points 23 provide well-defined contact junctions to metal housing 21 (shown in FIG. 9).

Crimp sleeve 6 is formed as a cap having a base plate 8 and inner surfaces provided with a structured (e.g., gripping) inner contour 7. Base plate 8 has a circularly shaped aperture passage 16 extending therethrough and bordered by inner contour 7.

Referring now to FIGS. 2, 3, 4, 5, 6, and 7, with continual reference to FIG. 1, sequential steps in the assembly of the contact element on cable 5 are respectively shown. Each of FIGS. 2, 3, 4, 5, 6, and 7 includes a cross-sectional view a) and a plan view b) of a respective assembly step.

FIGS. 2, 3, 4, 5, 6, and 7 clarify the mounting of the two-component contact element on cable 5. Cable 5 has a cable shield formed as a braided shield 4. Cable 5 is shown as a high-voltage coaxial cable. Such high-voltage coaxial cables 5 are used, for example, in electrically powered motor vehicles and carry both relatively high currents and voltages.

Cable 5 further has an inner conductor 9, an inner insulation 11, and an outer cable sheath 10. Inner insulation 11 is between braided shield 4 and inner conductor 9 and lies beneath the braided shield. Cable sheath 10 lies above braided shield 4 and forms an exterior insulating layer of cable 5. Inner conductor 9 is shown in FIGS. 2, 3, 4, 5, 6, and 7 as a simplified solid object made of a plurality of individual strands in order to increase the flexibility of cable 5. Braided shield 4 surrounding inner insulation 11 is primarily responsible for keeping interference radiation in cable 5 as small as possible. In this application it is important that while preparing cable 5 no part of inner conductor 9 or braided shield 4 is accessible, or that no leftover part remains, which could give rise to dangerous short circuits when detached from cable 5.

Figure 2:
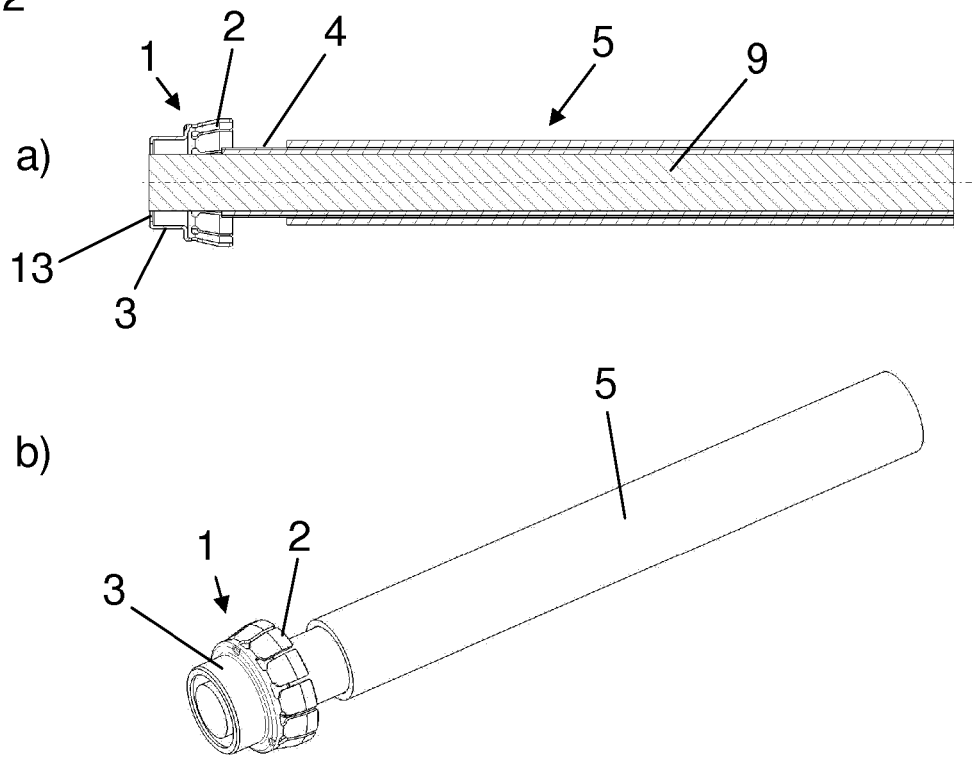
FIGS. 2, 3, 4, 5, 6, and 7 respectively illustrate steps in the assembly of the contact element on a shielded cable shown with each of FIGS. 2, 3, 4, 5, 6, and 7 having a cross-sectional view a) and a plan view b)

FIG. 2 illustrates the first assembly step as the pushing of spring contact sleeve 1 onto a free cable 5 whose end section has already been stripped. Collar 13 of annular ring 3 of spring contact sleeve 1 constricts the aperture passage of the annular ring on the one end section of cable 5.

Figure 3:
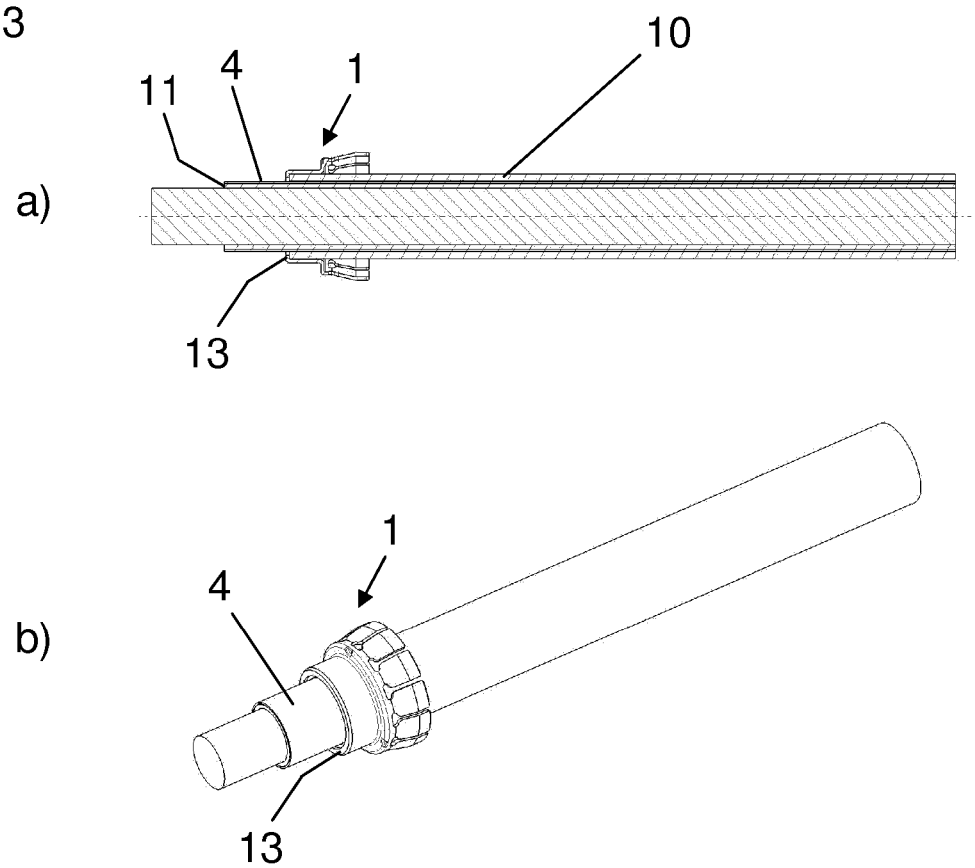
Figure 4:
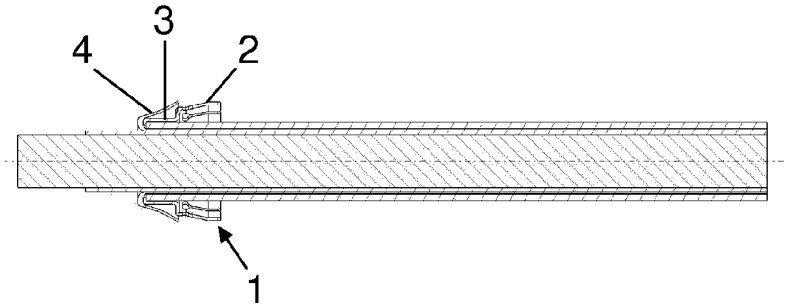
Figure 4:
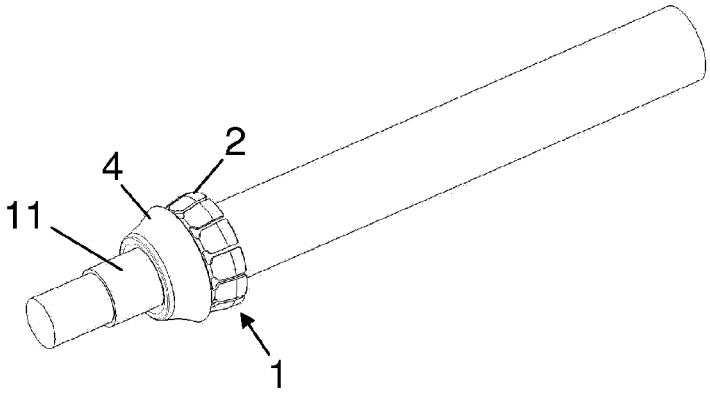

FIG. 3 illustrates the second assembly step. As shown in FIG. 3, to further connect spring contact sleeve 1 to cable 5, annular ring 3 of spring contact sleeve 1 is pushed onto cable 5 until collar 13 of annular ring 3 strikes the front edge of cable sheath 10. Because of this an exact and secure positioning of spring contact element 1 with respect to cable 5 is obtained.

As further shown in FIG. 3, braided shield 4 and inner insulation 11 are cut to the same length. This length is chosen so that in the next sequential assembly step, shown in FIG. 4, the folding back of braided shield 4 in the direction of spring contact sleeve 1 is such that braided shield 4 covers annular ring 3 of spring contact sleeve 1.

Figure 5:
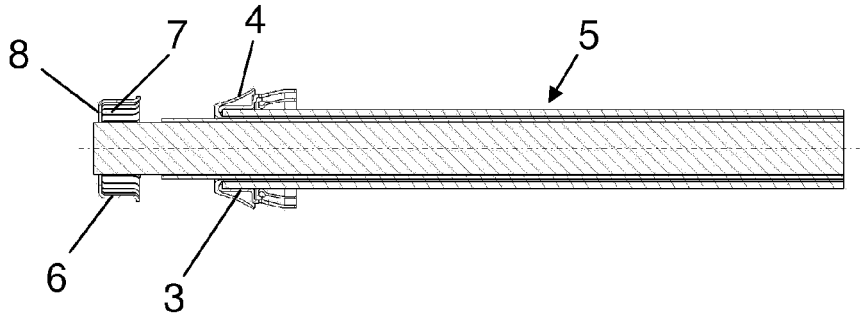
Figure 5:
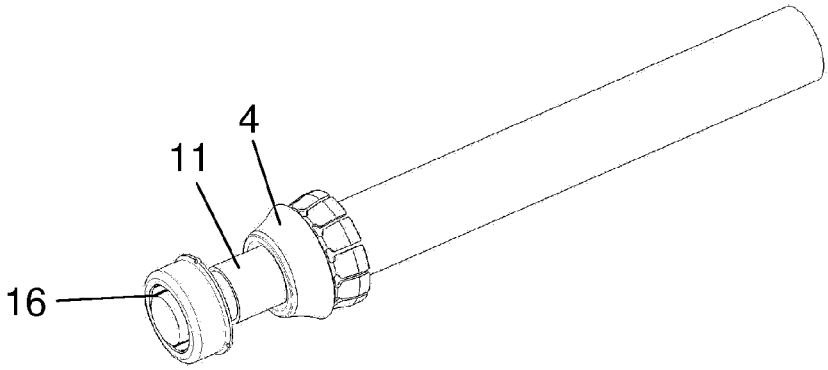

In the next sequential assembly step, shown in FIG. 5, crimp sleeve 6 is pushed over the free end of cable 5. The cap-shaped crimp sleeve 6 has aperture 16 in its base plate 8. The diameter of aperture 16 of crimp sleeve 6 corresponds as precisely as possible to the cross-section of cable 5 in the region of inner insulation 11 of cable 5. The edge of aperture 16 of crimp sleeve 6 thereby lies tightly on inner insulation 11 of cable 5.

In contrast, the open side of crimp sleeve 6 is wider than annular ring 3 of spring contact sleeve 1. As a result, crimp sleeve 6 can be pushed over annular ring 3 and braided shield 4 that lies on it.

Pushing of crimp sleeve 6 onto cable 5 is accomplished by using a superimposed rotational motion. The inner surface of crimp sleeve 6 has integrally molded structured inner contour 7. Inner contour 7 is designed as a screw like inner thread, as indicated to some extent in the figures. When crimp sleeve 6 is rotated, braided shield 4 is carried with crimp sleeve 6 by its inner contour 7 in the direction of motion and is pulled completely under crimp section 6.

Figure 6:
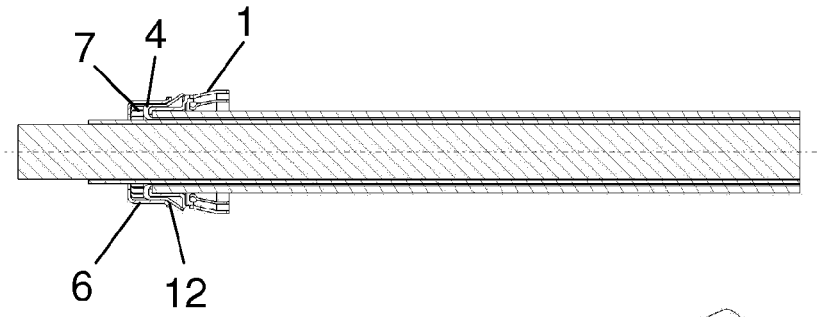
Figure 6:
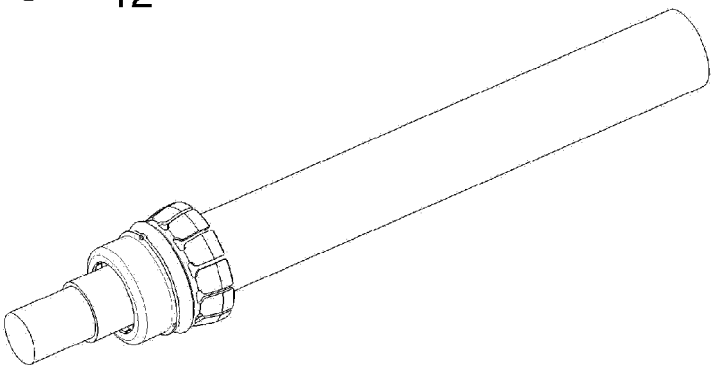

In the next sequential assembly step, shown in FIG. 6, crimp sleeve 6 is already partially pushed over annular ring 3 of spring contact sleeve 1. Flared cams 12 on crimp sleeve 6 function as catches during the rotational motion for sections of wire of braided shield 4 protruding between crimp sleeve 6 and annular ring 3 of spring contact sleeve 1. Crimp sleeve 6 is rotated until cams 12 insert into matching shaped wells 22 in annular ring 3 of spring contact sleeve 1 (shown in FIG. 1).

Figure 7:
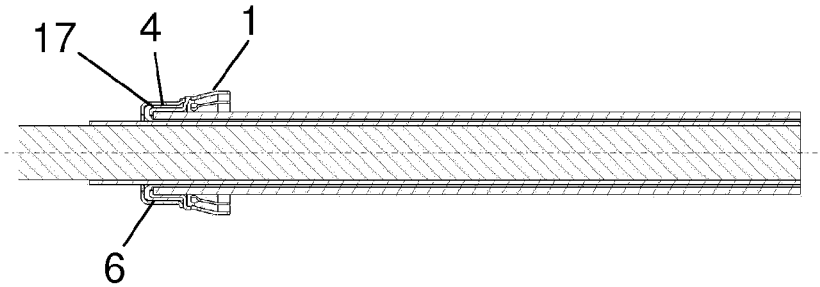
Figure 7:
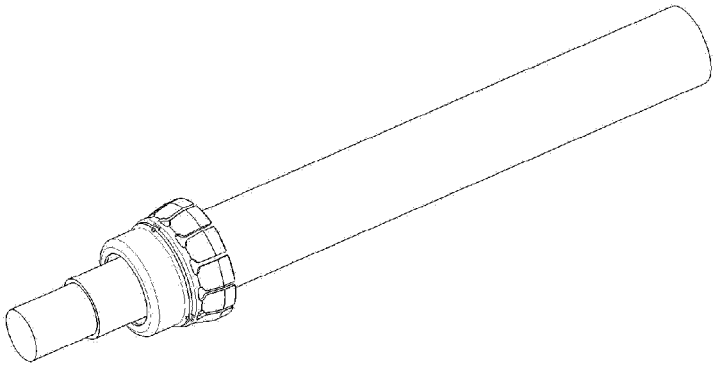

The finished assembly, shown in FIG. 7, is hereby produced in which crimp sleeve 6 has arrived at its final position. In this final position, the leading edge of crimp sleeve 6 now rests against spring contact sleeve 1. A hollow cavity 17 whose boundary walls completely encapsulate braided shield 4 remains because of its shape between crimp sleeve 6 and spring contact sleeve 1.

Crimp sleeve 6 is then connected to spring contact sleeve 1 so that it cannot be released by a crimp (not shown). A secure mechanical and electrical connection is produced in this manner between braided shield 4 of cable 5 and spring contact sleeve 1.

Figure 8:
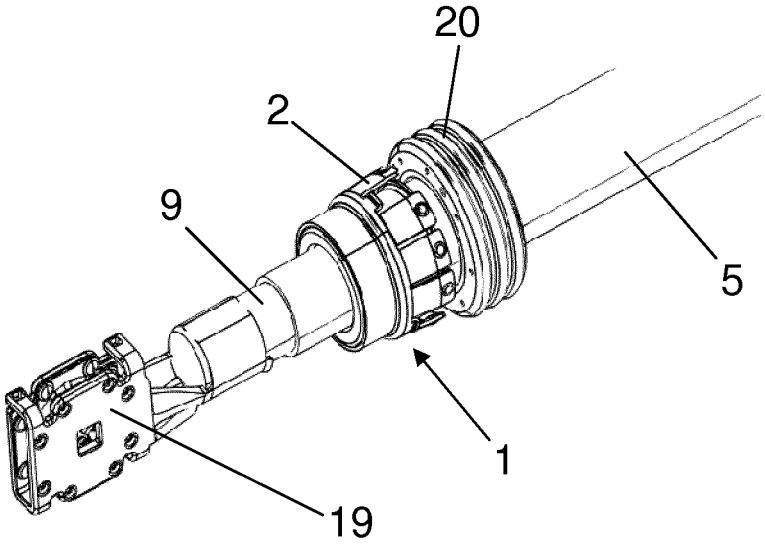
FIGS. 8 and 9 illustrate an application example of the shield connection of the contact element to the shielded cable.
Figure 9:
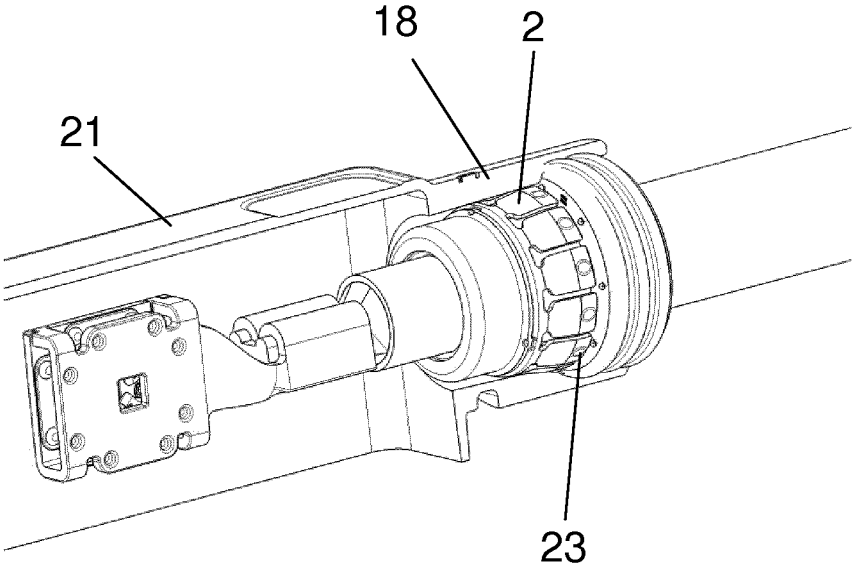

The arrangement described thus far can be supplemented by connecting to a screened plug-in connector. To this end, a socket contact 19 can be crimped to inner conductor 9 of cable 5, as is shown in FIG. 8. Socket contact 19, shown as an example in FIGS. 8 and 9, is provided to accommodate flat connector pins. To achieve a moisture-proof seal, a sealing gasket 20 can be attached to cable 5.

The preassembled component is then inserted into a metal housing 21, as shown in FIG. 9 in a sectional view. Spring contacts 2 of spring contact sleeve 1 resting against the inside of socket section 18 produce an electrical connection between braided shield 4 of cable 5 and metal housing 21.

REFERENCE SYMBOL LIST

1 spring contact sleeve
2 spring contacts of spring contact sleeve
3 annular ring of spring contact sleeve
4 braided shield of cable
5 cable (high-voltage coaxial cable)
6 crimp sleeve
7 inner contour of crimp sleeve
8 base plate of crimp sleeve
9 inner conductor of cable
10 cable sheath
11 inner insulation of cable
12 cams
13 collar
14 first portion of a spring contact
15 second portion of a spring contact
16 aperture passage
17 hollow cavity
18 socket section
19 socket contact
20 seal
21 metal housing
22 wells
23 contact point of a spring contact While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A contact element for connecting to a cable having a braided shield, comprising:

a spring contact sleeve having an annular ring and a plurality of spring contacts, the annular ring having a forward end and a rearward end, the spring contacts arranged circumferentially on the rearward end of the annular ring;

a crimp sleeve; and wherein the spring contact sleeve and the crimp sleeve form an enclosed hollow cavity between the crimp sleeve and the annular ring from the forward end of the annular ring to the rearward end of the annular ring when the crimp sleeve is crimped to the rearward end of the annular ring, the hollow cavity configured to fully receive therein an exposed portion of the braided shield provided for connection of the contact element to the cable.

2. The contact element of claim 1 wherein:

the spring contacts have free end portions extending away from the rearward end of the annular ring.

3. The contact element of claim 1 wherein:

each spring contact has a first spring contact portion and a second spring contact portion, the first spring contact portions ascend relative to an axis of symmetry of the spring contact sleeve more than the second spring contact portions.

4. The contact element of claim 1 wherein:

the annular ring has an uninterrupted surface.

5. The contact element of claim 1 wherein:

the annular ring has a collar on the forward end of the annular ring.

6. The contact element of claim 1 wherein:

the crimp sleeve has a form of a cap.

7. The contact element of claim 6 wherein:

the crimp sleeve has a base plate having a circular-shaped aperture passage.

8. The contact element of claim 1 wherein:

the crimp sleeve has an inner contour structure.

9. The contact element of claim 8 wherein:

the inner contour structure of the crimp sleeve has one of a spiral, helix, diamond shaped, and corrugated pattern.

10. A cable assembly comprising:

a cable having a braided shield;

a contact element having a spring contact sleeve and a crimp sleeve, the spring contact sleeve having an annular ring and a plurality of spring contacts arranged circumferentially on one end of the annular ring, the spring contact sleeve and the crimp sleeve together form an enclosed hollow cavity between one another when the crimp sleeve is joined to the annular ring;

wherein the spring contact sleeve and the crimp sleeve are placed on the cable with the cable extending through aperture passages of the spring contact sleeve and the crimp sleeve and the crimp sleeve is joined to the annular ring to thereby form the enclosed hollow cavity between the spring contact sleeve and the crimp sleeve, the hollow cavity fully receives therein in a physical contact manner an exposed portion of the braided shield to thereby electrically connect the contact element to the cable; and wherein the crimp sleeve has an inner grip contour structure around the aperture passage of the crimp sleeve, wherein the inner grip contour structure enables the exposed portion of the braided shield to be pulled underneath the crimp sleeve and into the hollow cavity during rotational movement of the crimp sleeve while the crimp sleeve is being joined to the spring contact sleeve.

11. The assembly of claim 10 wherein:

the plurality of spring contacts form a lamellar crown that opens in a direction extending away from the one end of the annular ring.

12. The assembly of claim 10 wherein:

each spring contact has a first spring contact portion, a second spring contact portion, and a contain point of the second spring contact portion, the first spring contact portion ascends relative to an axis of symmetry of the spring contact sleeve more than the second spring contact portion.

13. The assembly of claim 12 further comprising:

a socket contact connected to an inner conductor of the cable; and a metal housing for the socket contact, the metal housing pushed over the contact element with the first spring contact portions being pushed radially inward by a socket portion of the metal housing and the second spring contact portions lying against the socket portion of the metal housing with the contact points being in contact with the metal housing.

14. The assembly of claim 10 wherein:

the annular ring has a collar on another end, wherein a diameter of the collar is smaller than a diameter of the aperture passage of the spring contact sleeve.

15. The assembly of claim 14 wherein:

the cable further has an inner insulation beneath the braided shield and an outer sheath above the braided shield; and the spring contact sleeve is placed on the cable such that the collar of the annular ring strikes a front edge of the outer sheath to thereby provide an identifiable positioning of the spring contact sleeve with respect to the cable.

16. The assembly of claim 15 wherein:

the inner insulation and the exposed portion of the braided shield are cut to a same length from where the collar strikes the front edge of the outer sheath.

17. The assembly of claim 10 wherein:

a diameter of the aperture passage of the crimp sleeve is smaller than a diameter of the aperture passage of the spring contact sleeve.

18. The assembly of claim 10 wherein:

the crimp sleeve has an open side, wherein the open side of the crimp sleeve is pushed over the annular ring to form the hollow cavity between the spring contact sleeve and the crimp sleeve when the crimp sleeve is joined to the annular ring.

19. A contact element for connecting to a cable having a braided shield, comprising:

a spring contact sleeve having an annular ring and a plurality of spring contacts arranged circumferentially on one end of the annular ring;

a crimp sleeve; and wherein the spring contact sleeve and the crimp sleeve form an enclosed hollow cavity between one another when the crimp sleeve is joined to the annular ring, the hollow cavity configured to fully receive therein an exposed portion of the braided shield provided for connection of the contact element to the cable;

wherein the annular ring includes wells and the crimp sleeve includes cams, wherein the cams of the crimp sleeve respectively insert into the wells of the annular ring when the crimp sleeve is joined to the annular ring.

20. A cable assembly comprising:

a cable having a braided shield;

a contact element having a spring contact sleeve and a crimp sleeve, the spring contact sleeve having an annular ring and a plurality of spring contacts arranged circumferentially on one end of the annular ring, the spring contact sleeve and the crimp sleeve together form an enclosed hollow cavity between one another when the crimp sleeve is joined to the annular ring;

wherein the spring contact sleeve and the crimp sleeve are placed on the cable with the cable extending through aperture passages of the spring contact sleeve and the crimp sleeve and the crimp sleeve is joined to the annular ring to thereby form the enclosed hollow cavity between the spring contact sleeve and the crimp sleeve, the hollow cavity fully receives therein in a physical contact manner an exposed portion of the braided shield to thereby electrically connect the contact element to the cable;

wherein each spring contact has a first spring contact portion, a second spring contact portion, and a contain point of the second spring contact portion, the first spring contact portion ascends relative to an axis of symmetry of the spring contact sleeve more than the second spring contact portion;

a socket contact connected to an inner conductor of the cable; and a metal housing for the socket contact, the metal housing pushed over the contact element with the first spring contact portions being pushed radially inward by a socket portion of the metal housing and the second spring contact portions lying against the socket portion of the metal housing with the contact points being in contact with the metal housing.

* * * * *